US010156102B2

(12) United States Patent
Derkacz et al.

(10) Patent No.: US 10,156,102 B2
(45) Date of Patent: Dec. 18, 2018

(54) GAP ASSEMBLY FOR EM DATA TELEMETRY

(71) Applicant: EVOLUTION ENGINEERING INC., Calgary (CA)

(72) Inventors: Patrick R. Derkacz, Calgary (CA); Aaron W. Logan, Calgary (CA); Justin C. Logan, Calgary (CA)

(73) Assignee: Evolution Engineering Inc., Calgary (CA)

( * ) Notice: Subject to any disclaimer, the term of this patent is extended or adjusted under 35 U.S.C. 154(b) by 90 days.

(21) Appl. No.: 15/306,040

(22) PCT Filed: May 8, 2015

(86) PCT No.: PCT/CA2015/050414
§ 371 (c)(1),
(2) Date: Oct. 21, 2016

(87) PCT Pub. No.: WO2015/168803
PCT Pub. Date: Nov. 12, 2015

(65) Prior Publication Data

US 2017/0044839 A1 Feb. 16, 2017

Related U.S. Application Data

(60) Provisional application No. 62/014,000, filed on Jun. 18, 2014, provisional application No. 62/004,079, (Continued)

(51) Int. Cl.

| | |
|---|---|
| ***E21B 17/02*** | (2006.01) |
| ***E21B 47/12*** | (2012.01) |
| ***E21B 17/00*** | (2006.01) |
| ***E21B 17/042*** | (2006.01) |
| ***E21B 47/01*** | (2012.01) |
| *E21B 4/02* | (2006.01) |

(52) U.S. Cl.
CPC ..... *E21B 17/028* (2013.01); *E21B 17/003* (2013.01); *E21B 17/042* (2013.01); *E21B 47/011* (2013.01); *E21B 47/122* (2013.01); *E21B 4/02* (2013.01)

(58) Field of Classification Search
CPC ..... E21B 17/028; E21B 17/003
USPC ..... 166/65.1
See application file for complete search history.

(56) References Cited

U.S. PATENT DOCUMENTS

| | | |
|---|---|---|
| 2,112,108 A | 3/1938 | MacKenzie |
| 2,243,272 A | 5/1941 | Delbert |

(Continued)

FOREIGN PATENT DOCUMENTS

| | | |
|---|---|---|
| CA | 2502154 A1 | 10/2005 |
| CA | 2510435 A1 | 12/2005 |

(Continued)

*Primary Examiner* — Taras P Bemko
(74) *Attorney, Agent, or Firm* — Oyen Wiggs Green & Mutala LLP

(57) ABSTRACT

A gap sub has electrically-conductive parts held together by electrical insulators which engage in channels formed in the parts. The electrical insulators hold the parts in a spaced-apart electrically-insulated relationship. In some embodiments, the electrical insulators are removable to allow separation of the parts. An insulating oil or other fluid may fill the gap.

31 Claims, 7 Drawing Sheets

Related U.S. Application Data filed on May 28, 2014, provisional application No. 61/991,259, filed on May 9, 2014, provisional application No. 61/991,262, filed on May 9, 2014, provisional application No. 61/990,244, filed on May 8, 2014.

(56) References Cited

U.S. PATENT DOCUMENTS

| | | | | |
|---|---|---|---|---|
| 2,295,720 | A | 9/1942 | Dietzmann et al. | |
| 3,094,852 | A | 6/1963 | Taylor | |
| 3,380,324 | A | 4/1968 | Hillman | |
| 3,434,191 | A | 3/1969 | Timmons | |
| 3,463,247 | A | 8/1969 | Klein | |
| 3,915,243 | A | 10/1975 | Hisey et al. | |
| 3,980,143 | A | 9/1976 | Swartz et al. | |
| 4,023,449 | A | 5/1977 | Boyadjieff | |
| 4,147,215 | A | 4/1979 | Hodge et al. | |
| 4,194,579 | A | 3/1980 | Bailey et al. | |
| 4,240,652 | A | 12/1980 | Wong et al. | |
| 4,445,265 | A | 5/1984 | Olson et al. | |
| 4,496,174 | A * | 1/1985 | McDonald | E21B 17/003 285/330 |
| 4,520,468 | A | 5/1985 | Scherbatskoy | |
| 4,658,915 | A | 4/1987 | Goris et al. | |
| 4,844,171 | A | 7/1989 | Russell, Jr. | |
| 5,267,621 | A | 12/1993 | Deken et al. | |
| 5,544,712 | A | 8/1996 | McEwen et al. | |
| 5,740,860 | A | 4/1998 | Crawford et al. | |
| 5,817,937 | A | 10/1998 | Beshoory et al. | |
| 5,996,712 | A | 12/1999 | Boyd | |
| 6,098,727 | A * | 8/2000 | Ringgenberg | E21B 17/028 166/242.6 |
| 6,305,723 | B1 | 10/2001 | Schutz et al. | |
| 6,488,323 | B1 | 12/2002 | Bouligny | |
| 6,845,826 | B1 | 1/2005 | Feld et al. | |
| 7,252,160 | B2 | 8/2007 | Dopf et al. | |
| 7,255,183 | B2 | 8/2007 | Cramer | |
| 7,387,167 | B2 * | 6/2008 | Fraser | E21B 17/028 166/242.1 |
| 7,390,032 | B2 | 6/2008 | Hughes | |
| 7,543,650 | B2 | 6/2009 | Richardson | |
| 8,258,976 | B2 | 9/2012 | Price et al. | |
| 8,308,199 | B2 | 11/2012 | Camwell et al. | |
| 8,376,065 | B2 | 2/2013 | Teodorescu et al. | |
| 8,400,160 | B2 | 3/2013 | Fredette et al. | |
| 8,407,006 | B2 | 3/2013 | Gleitman | |
| 8,648,733 | B2 | 2/2014 | Dopf et al. | |
| 8,695,727 | B2 | 4/2014 | Chau et al. | |
| 8,704,677 | B2 | 4/2014 | Prammer | |
| 2005/0167157 | A1 | 8/2005 | Boyadjieff | |
| 2006/0089804 | A1 | 4/2006 | Chen et al. | |
| 2006/0201717 | A1 * | 9/2006 | Cramer | E21B 17/028 175/320 |
| 2006/0225891 | A1 | 10/2006 | Adams et al. | |
| 2007/0063513 | A1 | 3/2007 | Boyd | |
| 2008/0191900 | A1 * | 8/2008 | Camwell | E21B 17/028 340/854.3 |
| 2010/0032210 | A1 | 2/2010 | Teodorescu et al. | |
| 2010/0263495 | A1 | 10/2010 | Webb | |
| 2011/0120269 | A1 | 5/2011 | McCormick et al. | |
| 2011/0180273 | A1 | 7/2011 | Hughes et al. | |
| 2011/0254695 | A1 | 10/2011 | Camwell et al. | |
| 2012/0067649 | A1 | 3/2012 | Wilson | |
| 2012/0085583 | A1 | 4/2012 | Logan et al. | |
| 2012/0137833 | A1 | 6/2012 | Pettit | |
| 2013/0032412 | A1 * | 2/2013 | Haugvaldstad | E21B 10/00 175/425 |
| 2013/0120154 | A1 | 5/2013 | Gleitman | |
| 2014/0083773 | A1 | 3/2014 | Minosyan et al. | |
| 2014/0131051 | A1 | 5/2014 | Pratt et al. | |
| 2014/0131994 | A1 | 5/2014 | Holmen et al. | |
| 2014/0150544 | A1 | 6/2014 | Logan et al. | |
| 2015/0114634 | A1 | 4/2015 | Limbacher | |
| 2017/0044853 | A1 | 2/2017 | Derkacz et al. | |
| 2017/0101829 | A1 | 4/2017 | Heide et al. | |

FOREIGN PATENT DOCUMENTS

| | | | |
|---|---|---|---|
| CA | 2570344 | A1 | 12/2005 |
| CA | 2586317 | A1 | 10/2007 |
| CA | 2796683 | A1 | 5/2013 |
| GB | 2404401 | A | 2/2005 |
| GB | 2470286 | A | 11/2010 |
| WO | 0109478 | A1 | 2/2001 |
| WO | 2010121345 | A1 | 10/2010 |
| WO | 2014031663 | A1 | 10/2010 |
| WO | 2011049573 | A1 | 4/2011 |
| WO | 2013037058 | A1 | 3/2013 |
| WO | 2014066972 | A1 | 5/2014 |
| WO | 2014075190 | A1 | 5/2014 |

* cited by examiner

GAP ASSEMBLY FOR EM DATA TELEMETRY

TECHNICAL FIELD

This application relates to subsurface drilling, specifically, to gap assemblies useful for EM telemetry. Embodiments are applicable to drilling wells for recovering hydrocarbons.

BACKGROUND

Recovering hydrocarbons from subterranean zones typically involves drilling wellbores.

Wellbores are made using surface-located drilling equipment which drives a drill string that eventually extends from the surface equipment to the formation or subterranean zone of interest. The drill string can extend thousands of feet or meters below the surface. The terminal end of the drill string includes a drill bit for drilling (or extending) the wellbore. Drilling fluid, usually in the form of a drilling "mud", is typically pumped through the drill string. The drilling fluid cools and lubricates the drill bit and also carries cuttings back to the surface. Drilling fluid may also be used to help control bottom hole pressure to inhibit hydrocarbon influx from the formation into the wellbore and potential blow out at surface.

Bottom hole assembly (BHA) is the name given to the equipment at the terminal end of a drill string. In addition to a drill bit, a BHA may comprise elements such as: apparatus for steering the direction of the drilling (e.g. a steerable downhole mud motor or rotary steerable system); sensors for measuring properties of the surrounding geological formations (e.g. sensors for use in well logging); sensors for measuring downhole conditions as drilling progresses; one or more systems for telemetry of data to the surface; stabilizers; heavy weight drill collars; pulsers; and the like. The BHA is typically advanced into the wellbore by a string of metallic tubulars (drill pipe).

Modern drilling systems may include any of a wide range of mechanical/electronic systems in the BHA or at other downhole locations. Such electronics systems may be packaged as part of a downhole probe. A downhole probe may comprise any active mechanical, electronic, and/or electromechanical system that operates downhole. A probe may provide any of a wide range of functions including, without limitation: data acquisition; measuring properties of the surrounding geological formations (e.g. well logging); measuring downhole conditions as drilling progresses; controlling downhole equipment; monitoring status of downhole equipment; directional drilling applications; measuring while drilling (MWD) applications; logging while drilling (LWD) applications; measuring properties of downhole fluids; and the like. A probe may comprise one or more systems for: telemetry of data to the surface; collecting data by way of sensors (e.g. sensors for use in well logging) that may include one or more of vibration sensors, magnetometers, inclinometers, accelerometers, nuclear particle detectors, electromagnetic detectors, acoustic detectors, and others; acquiring images; measuring fluid flow; determining directions; emitting signals, particles or fields for detection by other devices; interfacing to other downhole equipment; sampling downhole fluids; etc. A downhole probe is typically suspended in a bore of a drill string near the drill bit. Some downhole probes are highly specialized and expensive.

Downhole conditions can be harsh. A probe may experience high temperatures; vibrations (including axial, lateral, and torsional vibrations); shocks; immersion in drilling fluids; high pressures (20,000 p.s.i. or more in some cases); turbulence and pulsations in the flow of drilling fluid past the probe; fluid initiated harmonics; and torsional acceleration events from slip which can lead to side-to-side and/or torsional movement of the probe. These conditions can shorten the lifespan of downhole probes and can increase the probability that a downhole probe will fail in use. Replacing a downhole probe that fails while drilling can involve very great expense.

A downhole probe may communicate a wide range of information to the surface by telemetry. Telemetry information can be invaluable for efficient drilling operations. For example, telemetry information may be used by a drill rig crew to make decisions about controlling and steering the drill bit to optimize the drilling speed and trajectory based on numerous factors, including legal boundaries, locations of existing wells, formation properties, hydrocarbon size and location, etc. A crew may make intentional deviations from the planned path as necessary based on information gathered from downhole sensors and transmitted to the surface by telemetry during the drilling process. The ability to obtain and transmit reliable data from downhole locations allows for relatively more economical and more efficient drilling operations.

There are several known telemetry techniques. These include transmitting information by generating vibrations in fluid in the bore hole (e.g. acoustic telemetry or mud pulse (MP) telemetry) and transmitting information by way of electromagnetic signals that propagate at least in part through the earth (EM telemetry). Other telemetry techniques use hardwired drill pipe, fibre optic cable, or drill collar acoustic telemetry to carry data to the surface.

Advantages of EM telemetry, relative to MP telemetry, include generally faster baud rates, increased reliability due to no moving downhole parts, high resistance to lost circulating material (LCM) use, and suitability for air/underbalanced drilling. An EM system can transmit data without a continuous fluid column; hence it is useful when there is no drilling fluid flowing. This is advantageous when a drill crew is adding a new section of drill pipe as the EM signal can transmit information (e.g. directional information) while the drill crew is adding the new pipe. Disadvantages of EM telemetry include lower depth capability, incompatibility with some formations (for example, high salt formations and formations of high resistivity contrast), and some market resistance due to acceptance of older established methods. Also, as the EM transmission is strongly attenuated over long distances through the earth formations, it requires a relatively large amount of power so that the signals are detected at surface. The electrical power available to generate EM signals may be provided by batteries or another power source that has limited capacity.

A typical arrangement for electromagnetic telemetry uses parts of the drill string as an antenna. The drill string may be divided into two conductive sections by including an insulating joint or connector (a "gap sub") in the drill string. The gap sub is typically placed at the top of a bottom hole assembly such that metallic drill pipe in the drill string above the BHA serves as one antenna element and metallic sections in the BHA serve as another antenna element. Electromagnetic telemetry signals can then be transmitted by applying electrical signals between the two antenna elements. The signals typically comprise very low frequency AC signals applied in a manner that codes information for transmission to the surface. (Higher frequency signals attenuate faster than low frequency signals.) The electromagnetic signals may be detected at the surface, for example by measuring electrical potential differences between the drill string or a metal casing that extends into the ground and one or more ground rods.

Design of the gap sub is an important factor in an EM telemetry system. The gap sub must provide electrical isolation between two parts of the drill string as well as withstand the extreme mechanical loading induced during drilling and the high differential pressures that occur between the center and exterior of the drill pipe. Drill string components are typically made from high strength, ductile metal alloys in order to handle the loading without failure. Most electrically-insulating materials suitable for electrically isolating different parts of a gap sub are weaker than metals (e.g. rubber, plastic, epoxy) or quite brittle (ceramics). This makes it difficult to design a gap sub that is both configured to provide efficient transmission of EM telemetry signals and has the mechanical properties required of a link in the drill string.

There remains a need for gap subs that are compact and robust.

SUMMARY OF INVENTION

The following embodiments and aspects thereof are described and illustrated in conjunction with systems, tools, and methods which are meant to be exemplary and illustrate, not limiting in scope. In various embodiments, one or more of the above-described problems have been reduced or eliminated, while some embodiments are directed to other improvements.

One aspect of the invention provides a gap assembly useful in subsurface drilling. The gap assembly includes a drill string section having a longitudinal channel extending through it and a threaded pin at one end thereof for coupling to an adjacent drill string section. The drill string section includes electrically-conductive female and male portions spaced apart from one another and electrically insulated from one another. The female portion has an outer surface which provides threads of the pin and an inner surface which defines a bore through the female portion. The male portion includes a projecting part that extends axially from a first end thereto. The projecting part extends into the bore through the female portion and projects longitudinally into the threads of the pin.

In some embodiments, the gap assembly includes rigid electrically-insulating spacers located between the male and female portions.

In some embodiments, the male portion includes a first flange face on the first end of the male portion surrounding the projecting part and the female portion includes a second flange face facing the first flange face. A first plurality of the electrically-insulating spacers are received between the first and second flange faces.

In some embodiments, the first and second flange faces each have a circumferentially-extending groove. The first plurality of the electrically-insulating spacers are received between the circumferentially-extending grooves of the first and second flange faces.

In some embodiments, a second plurality of the electrically-insulating spacers are received between the projecting part of the male portion and the inner surface of the female portion.

In some embodiments, the projecting part of the male portion and the inner surface of the female portion are each formed to provide axially-extending grooves. At least some electrically-insulating spacers of the second plurality of electrically-insulating spacers are received between the axially-extending grooves of the projecting part of the male portion and the inner surface of the female portion.

In some embodiments, the projecting part of the male portion and the inner surface of the female portion are each formed to provide one or more circumferentially-extending grooves. At least some electrically-insulating spacers of the second plurality of electrically-insulating spacers are received between the circumferentially-extending grooves of the projecting part of the male portion and the inner surface of the female portion.

In some embodiments, the gap assembly includes one or more fill ports located in a compartment contained within the gap assembly and respectively connected to the circumferentially-extending grooves.

In some embodiments, the compartment is sealed against downhole pressures.

In some embodiments, the one or more circumferentially extending grooves includes a plurality of circumferentially-extending grooves and the one or more fill ports includes a separate fill port for each one of the circumferentially-extending grooves.

In some embodiments, the one or more circumferentially-extending grooves includes a groove that extends in a spiral or helix along the male portion.

In some embodiments, the male portion includes a first portion having a flange face which faces a corresponding flange face of the female portion, a second portion having circumferential channels, and a third portion having axially-extending channels. At least some of the spacers are in contact with each one of the first, second and third portions.

In some embodiments, the spacers include ceramic balls.

In some embodiments, the projecting part of the male portion is tubular and the longitudinal channel of the drill string section extends through the projecting part of the male portion.

In some embodiments, the gap assembly includes a flow tube extending through the longitudinal channel. The flow tube is made of an electrically-insulating material at least in a vicinity of the end of the projecting part of the male portion.

In some embodiments, the flow tube includes a first part axially aligned with a second part and seals sealingly arranged between the first and second parts and the longitudinal channel.

In some embodiments, the first part of the flow tube is made of ceramic, the second part of the flow tube is made of metal and the end of the projecting part of the male portions lies within the first part of the flow tube.

In some embodiments, the gap assembly includes a sleeve of an electrically-insulating material provided on the outside of a body of the male portion. The sleeve covers a portion of the body of the male portion that is closest to the female portion.

In some embodiments, the electrically-insulating material is selected from the group consisting of a glass-reinforced plastic, PEEK and ceramic.

In some embodiments, the sleeve has a length in the range of 1 inch (about 2½ cm) to 20 inches (about 50 cm).

In some embodiments, the gap assembly includes an electronics package housed in a cavity located between the longitudinal passage and an outer surface of the male portion.

In some embodiments, the electronics package includes one or both of an EM telemetry transmitter and an EM telemetry receiver connected electrically to each of the male portion and the female portion.

In some embodiments, the gap assembly includes a bolt extending from the cavity through an electrically-insulating sleeve, the bolt threadedly engaged with the female portion.

In some embodiments, one or both of the EM telemetry transmitter and the EM telemetry receiver is connected electrically to the female portion by way of the bolt.

In some embodiments, the space between the male and female portions is filled with solid, electrically-insulating material.

In some embodiments, the female portion is removably coupled to the male portion.

In some embodiments, the female portion is one of first and second interchangeable female portions having different configurations of threads on their outer surfaces.

In some embodiments, the threads of the pin extend along the female portion for at least one half of the length of the female portion.

In some embodiments, the gap assembly includes a dielectric liquid or fluid sealed in the gap between the male and female portions.

Another aspect of the invention provides a drill string including a mud motor coupled to drive a drill bit and a gap assembly according to any embodiment described herein between the mud motor and the drill bit.

Another aspect of the invention provides a gap assembly useful in subsurface drilling. The gap assembly includes an electrically-conductive first portion having a pin and having one or more first portion receivers, an electrically-conductive second portion couplable to the pin end of the first portion and having a box end including one or more second portion receivers, one or more axial channels defined by the first portion, and one or more circumferential channels defined by the first portion. The first portion receivers and the second portion receivers are complementarily shaped to define one or more receiving areas to receive one or more spacers when the first and second portions are coupled at the pin end and the box end. The one or more axial channels extend in substantially an axial direction of the first portion and are sized to receive the one or more spacers. Each of the one or more circumferential channels is defined about a circumference of the first portion, extends in a direction substantially transverse to the axial direction, and is sized to receive one or more spacers. When the pin end of the first portion is coupled to the box of the second portion and the one or more spacers are received by the one or more axial channels, the one or more circumferential channels, and the one or more receiving areas, the first and second portions are spaced apart to define a gap between the first and second portions so that the first portion is electrically isolated from the second portion.

In some embodiments, the second portion includes one or more channels complementary to at least one of the one or more axial channels and the one or more circumferential channels.

In some embodiments, the first portion receivers are defined by a first portion flange face at the pin end and the second portion receivers are defined by a second portion flange face at the box end.

In some embodiments, the receiving areas comprise flange channels.

In some embodiments, the gap assembly includes one or more fill ports sized to receive the one or more spacers. The one or more fill ports are in communication with at least one of the one or more circumferential channels so that the spacers received by the one or more fill ports are received by the at least one of the one or circumferential channels.

In some embodiments, the one or more fill ports define apertures in communication with an interior chamber of the first portion and the interior chamber is sealed from downhole pressures.

In some embodiments, the gap assembly includes an inlet for receiving fluid insulating material and an outlet for expressing fluid insulating material. The inlet is defined by the first portion at a first end of the gap and the outlet is defined by the first portion at a second end of the gap, the second end distal to the first end. The outlet is in communication with the inlet so that, while the first and second portions are coupled, fluid insulating material received at the inlet under pressure flows radially towards the outlet through the gap.

In some embodiments, the outlet is proximate to and in communication with at least one of the one or more axial channels.

In some embodiments, the gap assembly includes an electrically-insulating sleeve for increasing a longitudinal distance at which the first and second portions are spaced while the first and second portions are coupled. The sleeve is couplable to the first portion so that, while the first and second portions are coupled and the first portion and sleeve are coupled, the electrically-insulating sleeve is proximate to the second portion.

In some embodiments, the gap assembly includes a seal between the sleeve and the first portion for reducing ingress of drilling fluid proximate to the sleeve.

In some embodiments, the seal is proximate to a first end of the sleeve, the first end of the sleeve is distal to a second end of the sleeve, the second end of the sleeve is proximate to the second portion while the first and second portions are joined.

In some embodiments, the gap assembly includes an electrically-conductive member in electrical communication with the second portion. The member extends through the gap from the first potion towards the second portion. The member is in electrical communication with an EM telemetry system housed by the first portion.

In some embodiments, the EM telemetry system is in electrical communication with the first portion.

In some embodiments, while the first and second portions are joined, the member is received by the second portion so that the channels of the first and second portions are in alignment.

In some embodiments, the gap assembly includes a bore defined by the first portion and a flow tube lining the bore. At least a portion of the flow tube is electrically-insulating.

In some embodiments, the at least a portion of the flow tube is proximate to the gap.

In some embodiments, the flow tube extends axially through the first portion from a first end of the first portion to a second end of the first portion. The flow tube is sealable at the first and second ends of the first portion.

In some embodiments, at least one of the spacers includes a sphere.

In some embodiments, at least one of the spacers for receipt by the axial channels includes a rod.

In some embodiments, at least one of the spacers for receipt by receiving areas includes a ring, a plate, a disc, an arc, or a block.

In some embodiments, at least one of the circumferential channels includes a helix.

In some embodiments, at least one of the circumferential channels includes a spiral.

Another aspect of the invention provides a method for insulating a gap sub assembly, the gap sub assembly including an electrically-conductive first portion and an electrically-conductive second portion. The method includes inserting spacers into one or more axial channels defined by the first portion so that the spacers extend in substantially an axial direction of the first portion, inserting spacers into one or more circumferential channels defined by the first portion so that the spacers are positioned about a circumference of the first portion, the spacers extending in a direction substantially transverse to the first direction, inserting spacers into one or more receiving spaces defined by one or more first portion receivers at a pin end of the first portion and by one or more second portion receivers at a box end of the second portion, and coupling the first and second portions so that the first and second portions are spaced apart by the spacers to define a gap between the first and second portions, the first portion being electrically isolated form the second portion.

In some embodiments, the method includes inserting spacers into one or more channels defined by the second portion. The one or more channels are complementary to at least one of the one or more axial channels and the one or more circumferential channels.

In some embodiments, the method includes inserting spacers into the gap proximate to a flange face defined by the first portion at the pin end so that, while the first and second portions are coupled, the flange face is spaced apart from the second portion in the axial direction.

In some embodiments, the one or more first portion receivers include flange channels.

In some embodiments, at least one of inserting spacers into the one or more axial channels and inserting spacers into the one or more circumferential channels includes inserting spacers into a fill port defined by a surface of the first portion.

In some embodiments, the method includes injecting fluid insulating material into the gap.

In some embodiments, injecting fluid insulating material into the gap includes injecting fluid insulating material under pressure at an inlet in communication with the gap and expressing fluid insulating material at an outlet in communication with the gap so that the fluid insulating material flows radially towards the outlet through the gap.

In some embodiments, expressing fluid insulating material includes passing fluid material through the one or more axial channels.

In some embodiments, the method includes inserting a mandrel into a bore of the first portion so that vent holes of the mandrel correspond generally with the outlet.

In some embodiments, injecting fluid insulating material includes injecting fluid insulating material at an outer circumference of the gap so that the fluid insulating material flows toward an axial center of the first portion.

In some embodiments, the method includes coupling an electrically-insulating sleeve to the first portion so that a longitudinal distance at which the first and second portions are spaced while the first and second portions are coupled is increased and the electrically-insulating sleeve is proximate to the second portion.

In some embodiments, the method includes forming a seal between the sleeve and the first portion for reducing ingress of drilling fluid proximate to the sleeve.

In some embodiments, the seal is proximate to a first end of the sleeve, the first end of the sleeve distal to a second end of the sleeve, the second end of the sleeve proximate to the second portion while the first and second portions are joined.

In some embodiments, the method includes placing the member in contact with the second portion so that the member and the second portion are in electrical communication.

In some embodiments, while the first and second portions are joined, receiving the member with the second portion so that the channels of the first and second portions are in alignment.

In addition to the exemplary aspects and embodiments described above, further aspects and embodiments will become apparent by reference to the drawings and by study of the following detailed description.

BRIEF DESCRIPTION OF THE DRAWINGS

The accompanying drawings illustrate non-limiting example embodiments of the invention.

DESCRIPTION

Throughout the following description specific details are set forth in order to provide a more thorough understanding to persons skilled in the art. However, well known elements may not have been shown or described in detail to avoid unnecessarily obscuring the disclosure. The following description of examples of the technology is not intended to be exhaustive or to limit the system to the precise forms of any example embodiment. Accordingly, the description and drawings are to be regarded in an illustrative, rather than a restrictive, sense.

Figure 1:
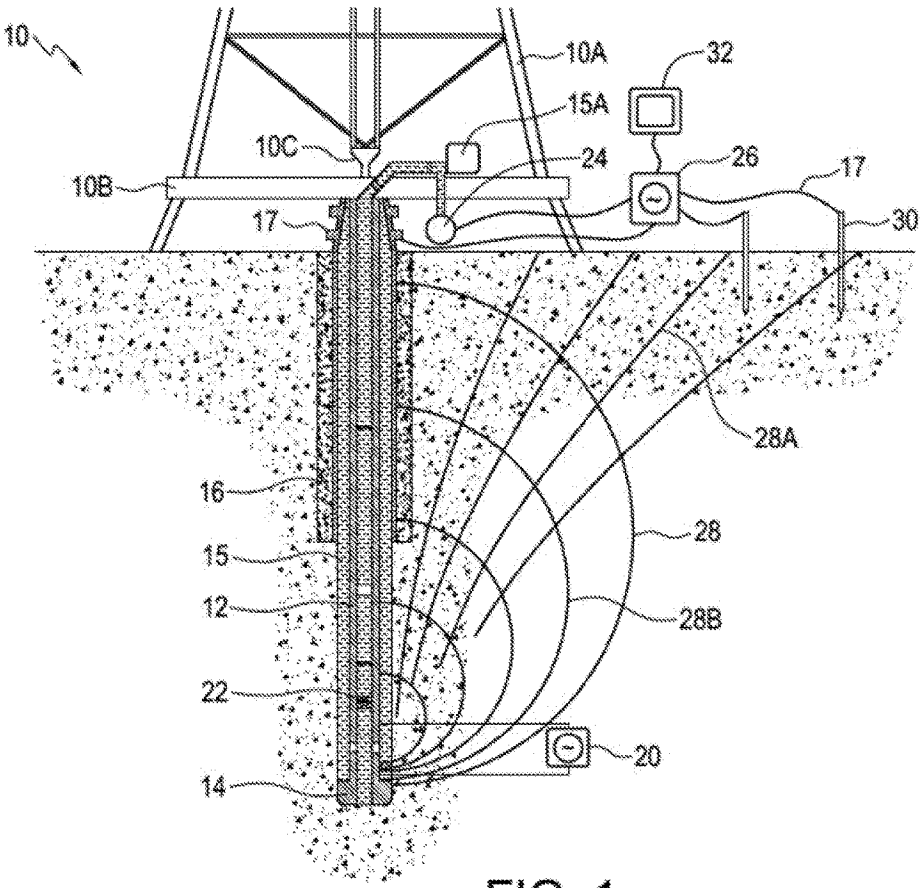
FIG. 1 is a schematic view of a drilling operation.

FIG. 1 shows schematically an example drilling operation. A drill rig 10 drives a drill string 12 which includes sections of drill pipe that extend to a drill bit 14. The illustrated drill rig 10 includes a derrick 10A, a rig floor 10B and draw works 10C for supporting the drill string. Drill bit 14 is larger in diameter than the drill string above the drill bit. An annular region 15 surrounding the drill string is typically filled with drilling fluid. The drilling fluid is pumped through a bore in the drill string to the drill bit and returns to the surface through annular region 15 carrying cuttings from the drilling operation. As the well is drilled, a casing 16 may be made in the well bore. A blow out preventer 17 is supported at a top end of the casing. The drill rig illustrated in FIG. 1 is an example only. The methods and apparatus described herein are not specific to any particular type of drill rig.

One aspect of this invention provides a novel constructions for a gap assembly. In some embodiments the gap assembly is designed to permit disassembly for service and then reassembly to place back into service. The illustrated gap assembly is particularly well adapted for use in the portion of a drill string between a mud motor and a drill bit, although its use is not so limited.

Figure 2:
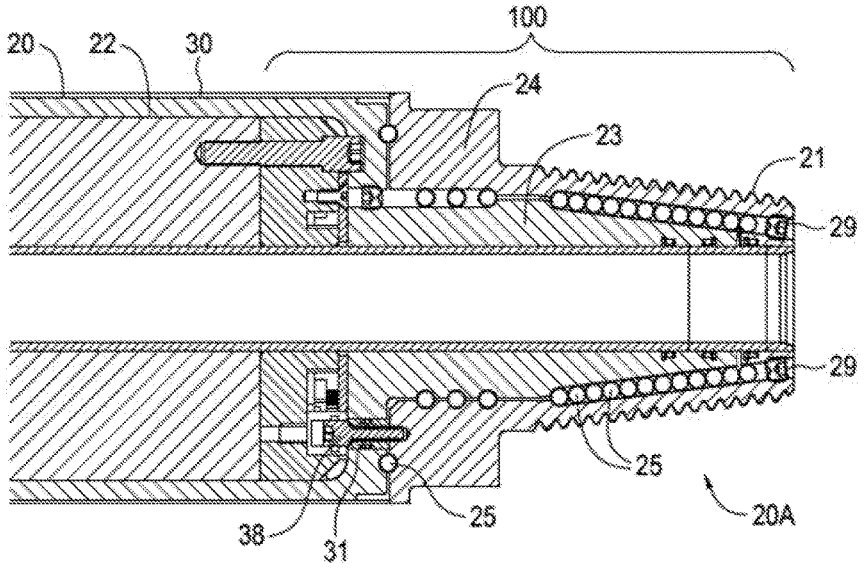
FIG. 2 is a cross-section of a gap assembly according to an example embodiment.

FIG. 2 is a cross section of a gap assembly according to an example embodiment. As shown, the gap assembly 100 is provided at the pin end 20A of a drill string section 20. The gap assembly provides electrical isolation between the pin 21 of drill string section 20 and the body 22 of drill string section 20. As shown, gap assembly 100 comprises a male portion 23 which is attached to, and is in electrical contact with, body 22 of drill string section 20 and a female portion 24 which includes pin 21.

Electrical isolation between the male and female portions 23, 24 is provided by electrically-insulating spacers 25. In the illustrated embodiment, however, as described in more detail below, at least some of spacers 25 may comprise electrically-insulating pieces of other shapes.

Figure 3:
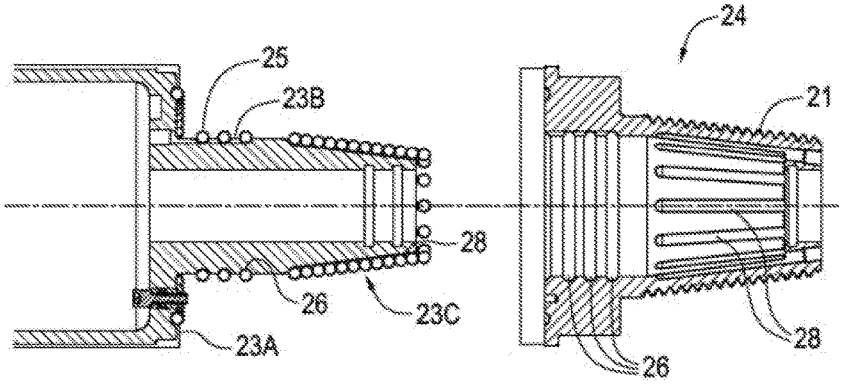
FIG. 3 is a cross-section of the gap assembly of FIG. 2 with male and female portions separated.
Figure 3A:
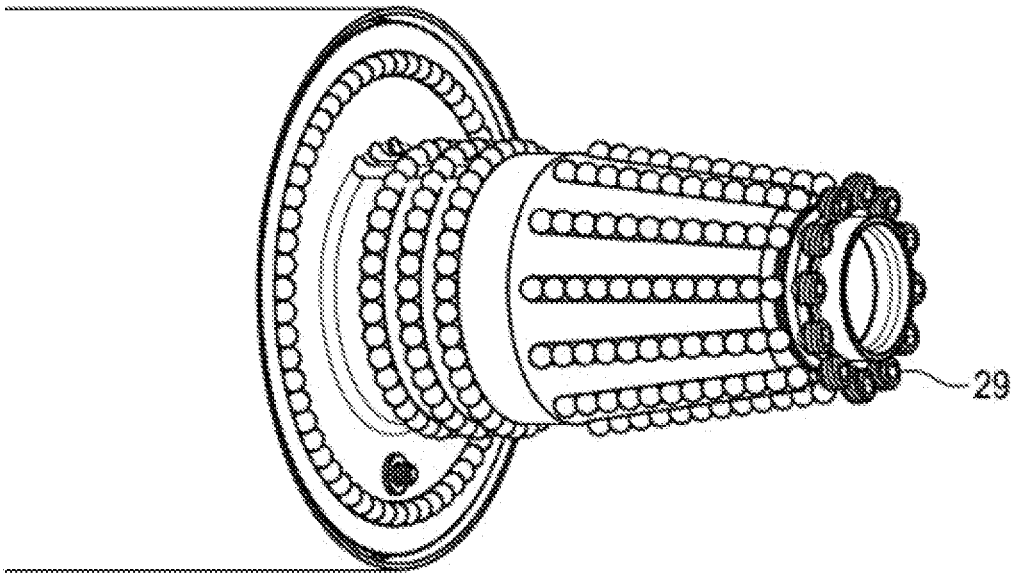
FIG. 3A is a perspective view of the male portion of the example gap assembly and insulating spacers.

FIG. 3 shows male portion 23 with female portion 24 removed. The contact surface of male portion 23 includes a flange face 23A, a portion 23B which includes circumferential channels 26 for receiving spacers 25 and a portion 23C which includes axially-extending channels 28 for receiving other spacers 25. Similar complementary channels are provided on inside surfaces of the female section.

The engagement between electrically-insulating spacers 25 and the axially-extending channels facilitates transfer of torque through gap sub assembly 100. The engagement of electrically-insulating spacers 25 in the circumferentially-extending channels facilitates transmission of tension and compression through gap assembly 100. The provision of electrically-insulating spacers 25 between the flange face 25A and a corresponding face on the female portion facilitates transmission of compressive forces through the gap assembly 100.

The insulating members that are located between flange face 23A and female section 24 resist compressive loads and prevent the ceramic balls in circumferential channels 26 from experiencing significant shear forces when gap assembly 20 is under compression.

In the illustrated embodiment, the male and female portions 23, 24 each have three circumferential channels 26 which receive electrically-insulating spacers such as ceramic balls. The number of circumferential channels may be varied. It is not mandatory that the circumferential channels be completely circular. The channels may be wavy to some degree while still permitting ceramic balls in the channels to withstand tension/compression axial forces. In other embodiments, channels 26 extend around male and female portions 23, 24 in a spiral or helix.

Axially-extending channels 28 may open at the tip of pin 21. These openings may be plugged with plugs at passages 29 after spacers have been inserted into channels 28.

The ceramic balls in the axially-extending channels may be replaced with other forms of electrical insulator. For example, the ceramic balls could be replaced by rods which may optionally be configured to screw into threaded end portions of the axially extending channels. Similarly, the ceramic balls 25 illustrated in the channels on flange face portion 23A could be replaced with insulating spacers of other shapes. For example, insulating spacers in the form of rings, plates, discs, arcs, block, or the like may be provided.

Figure 4A:
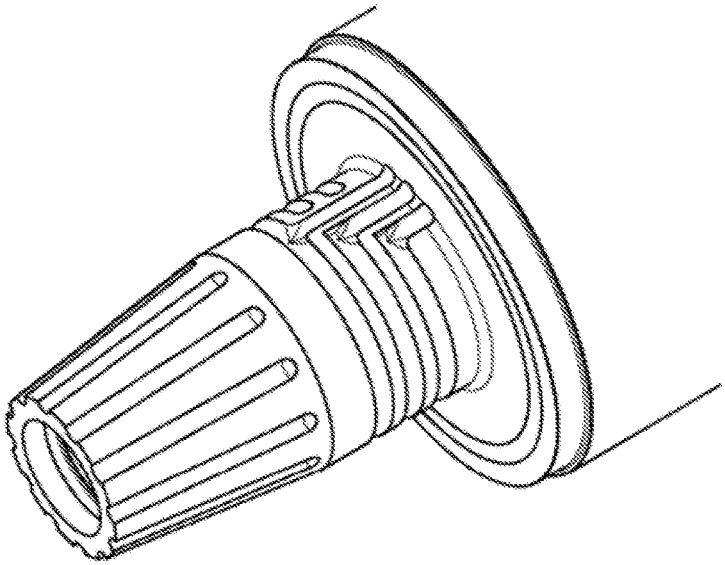
FIGS. 4A, 4B, and 4C are perspective views of the male portion of the gap assembly with the female portion and spacers removed.
Figure 4B:
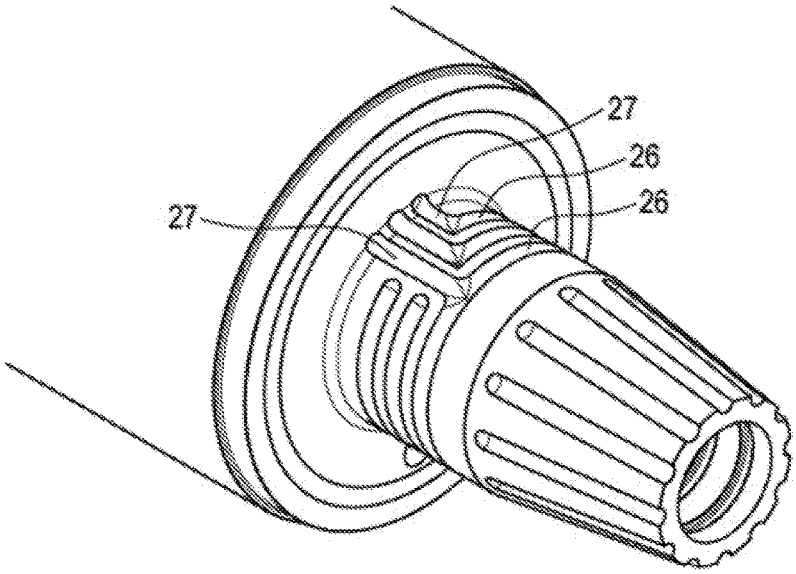
Figure 4C:
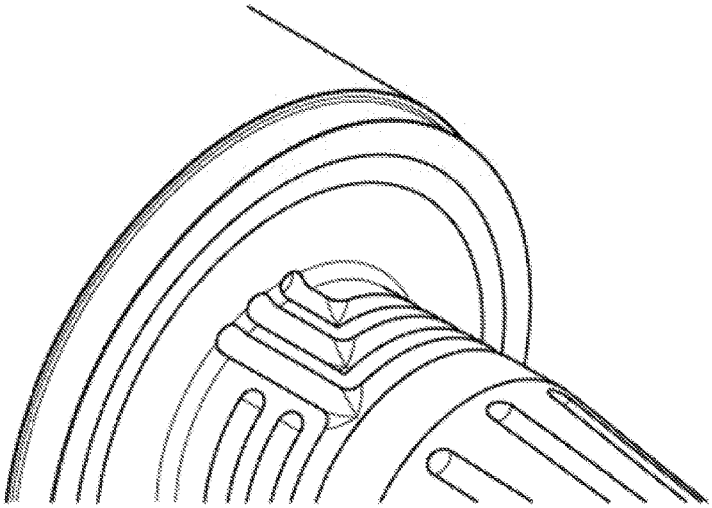

In some embodiments, channels 27 are provided to facilitate introduction of ceramic balls into circumferential channels 26 after the male and female portions 23, 24 have been mated together. The ceramic balls introduced into circumferential channels 26 can then hold together the mated male and female portions. FIGS. 4A, 4B, and 4C show an example embodiment in which passages 27 are provided through which ceramic balls may be introduced into circumferential channels 26 after the male and female portions have been mated together.

Figure 5:
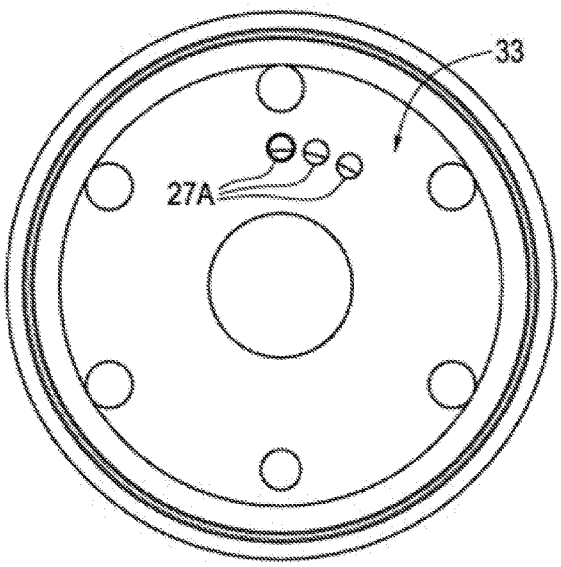
FIG. 5 is a cross-section through a gap sub looking toward a gap assembly.

Providing a separate fill port 27A for each circumferential channel 26 may facilitate easy assembly and disassembly of the gap assembly. The fill ports may be located in the interior of the drill string section. This protects the fill ports from possible damage by erosion. Fill ports 27A are shown in FIG. 5.

Furthermore, the fill ports through which ceramic balls may be introduced into the ceramic channels may be located in a portion of the assembly which is sealed from downhole pressures. This portion may, for example, house electronics or other downhole equipment. Providing the fill ports in this area prevents fluid ingress through the fill ports. In FIG. 5, fill ports 27A open into a chamber 35 into which electronics may be placed. The electronics may, for example, include an EM telemetry transmitter and/or an EM telemetry receiver. An EM telemetry transmitter may have outputs electrically coupled to the male and female portions of the gap assembly. An EM telemetry receiver may have inputs electrically coupled to the male and female portions of the gap assembly.

After assembly of the male and female portions and the hard electrical insulators (e.g. spacers 25) that keep them spaced apart, additional insulating material may be introduced into the gap between the male and female members. This additional electrically-insulating material may, for example, comprise settable material such as a suitable plastic, epoxy, cement, engineered resin, thermal plastic, or the like.

In other embodiments, the additional electrically-insulating material comprises a suitable electrically-insulating oil, or other dielectric liquid or fluid. In such other embodiments, suitable seals are provided to prevent ingress of drilling fluid between the male and female portions and to prevent the leakage of the electrically-insulating fluid or other dielectric material.

In some embodiments, the gap between the male and female portions is injected with a plastic material. It is advantageous in some cases to inject the plastic material from the outside diameter of gap assembly 100 so that the plastic flows radially inwardly past flange face 23A. Injection may be continued until the plastic flows into the bore of pin 21. For example the plastic material may flow through the gap and exit through passages 29 provided near to the ends of the axially-extending channels 28, thereby sealing the male and female portions together and also preventing any relative motion between the male and female portions.

During plastic injection, a mandrel may optionally be inserted into the bore of the male portion 23. Vent holes may be provided in the mandrel. The vent holes or another vent channel are arranged to correspond generally with passages 29 and/or axially-extending channels 28. The mandrel may be removed after plastic has been injected to fill the gap.

Figure 7:
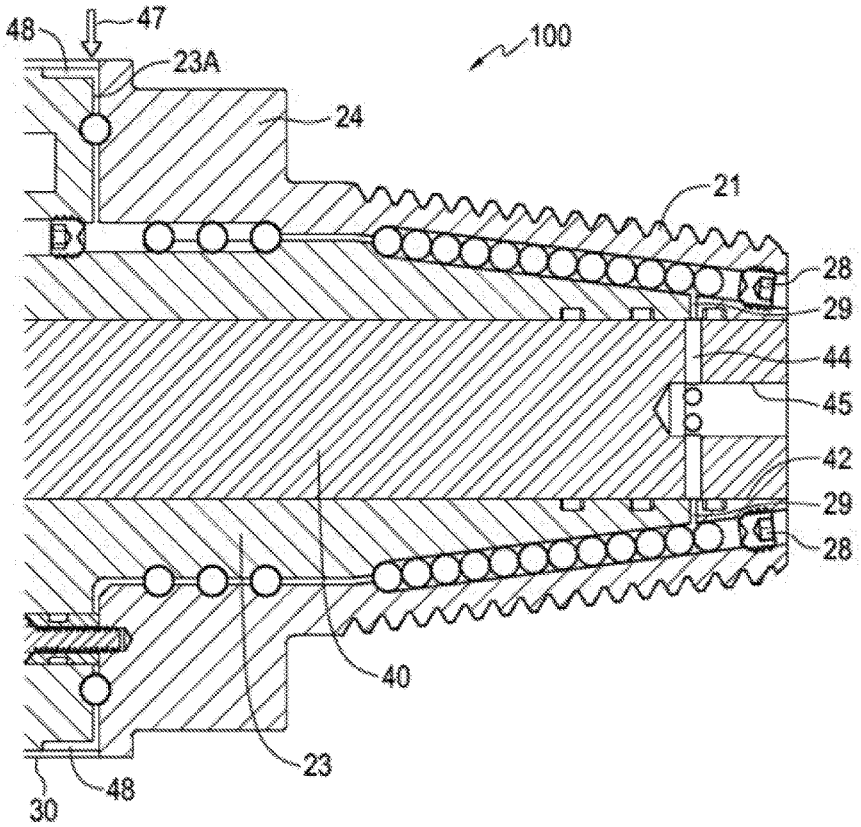
FIG. 7 is a longitudinal cross section illustrating a mandrel in a bore of an example gap sub.

FIG. 7 illustrates an example mandrel 40 inserted into a bore 42 of male portion 23. Mandrel 40 may comprise a rod having a close running fit in bore 42. Mandrel 40 comprises vents 44 which extend to the surface of mandrel 40 adjacent the end of male portion 23. In the illustrated embodiments, vents 44 comprise passages that extend radially to join a passage 45 that extends axially to the end of mandrel 40. In the embodiment illustrated in FIG. 7, the gap assembly 100 may be placed into a plastic injection mould which injects plastic from the outside diameter of gap sub assembly 100 as indicated by arrow 47. The plastic may flow through the gaps separating male portion 23 and female portion 21 past the end of male portion 23 into vents 44 located in bore 42.

The flowing plastic may force air out of the gap as it flows and fills the gap. In the illustrated embodiment, the outside diameter of male portion 23 is reduced in an area 48 near flange face 23A. Area 48 provides a channel to receive plastic material, facilitates distribution of plastic material around the circumference of gap assembly 100, and also makes alignment of gap assembly 100 with plastic injection ports of an injection mold less critical.

A layer of electrically-insulating material 30 (also referred to as 'sleeve 30') may be provided on the outside of section body 22 to increase the longitudinal separation on the outside of the drill string between electrically conducting parts on either side of the gap provided by the gap assembly described above. The electrically-insulating material may, for example, comprise a sleeve of a suitable glass-reinforced plastic, a ceramic material, or the like. This material may be coated on to the outside of the drill string segment 20 and/or heat shrunk in place and/or be a tight fit onto the outer surface of drill string segment 20. In some embodiments, O-rings or other seals are provided to seal behind the sleeve 30 to prevent the ingress of drilling fluid behind sleeve 30 and/or into the gap.

Particularly when gap assembly 100 is used in the portion of a drill string between a mud motor and a drill bit, the plastic sleeve or other electrically-insulating material 30 is relatively well protected from erosion and damage from contact with the walls of the bore hole. This is because the gap assembly will typically remain centralized in the bore hole by the bit, which is nearby.

The gap length may be varied by altering the length of sleeve 30. For example, in some embodiments, the gap may have a length in the range of 1 inch (about 2½ cm) to 20 inches (about 50 cm). Smaller or longer gaps may be provided. For example, gaps of ¼ inch (about 6 mm) or more may be provided. In some cases, such as where a short gap is acceptable, sleeve 30 may be omitted.

Sleeve 30 may be rated for downhole temperatures. Appropriate grades of PPS or PEEK plastic tend to be a good material to use for sleeve 30 because of such materials' anti-erosion characteristics and cost-effectiveness.

As best illustrated in FIG. 2, in some embodiments, an electrical conductor is provided that extends across the gap and makes contact with female section 24. The illustrated embodiment shows a bolt 32 which extends through an electrically-insulating sleeve 31 to make contact with female portion 24. In the illustrated embodiment, bolt 32 threads into a threaded bore in female portion 24. Electronics may then make electrical contact with pin 21 of segment 20 by way of bolt 32 or other electrically conducting member. In an example embodiment, one terminal of an EM telemetry transmitter, receiver, or transceiver is connected to pin 21 via bolt 32. In some embodiments the head of bolt 32 projects into an electronics assembly.

Bolt 32 may optionally serve to aid assembly of gap assembly 100 by keying together members 23, 24 in a position (e.g. a rotational orientation) in which corresponding channels are aligned to receive spacers.

In those embodiments where the gap assembly is not filled with a setting material which prevents disassembly of the gap assembly 100, the gap assembly may be disassembled, for example by removing ceramic balls from the circumferentially extending channels 26 and then taking the gap assembly apart. Each component can then be serviced, as required.

Figure 6:
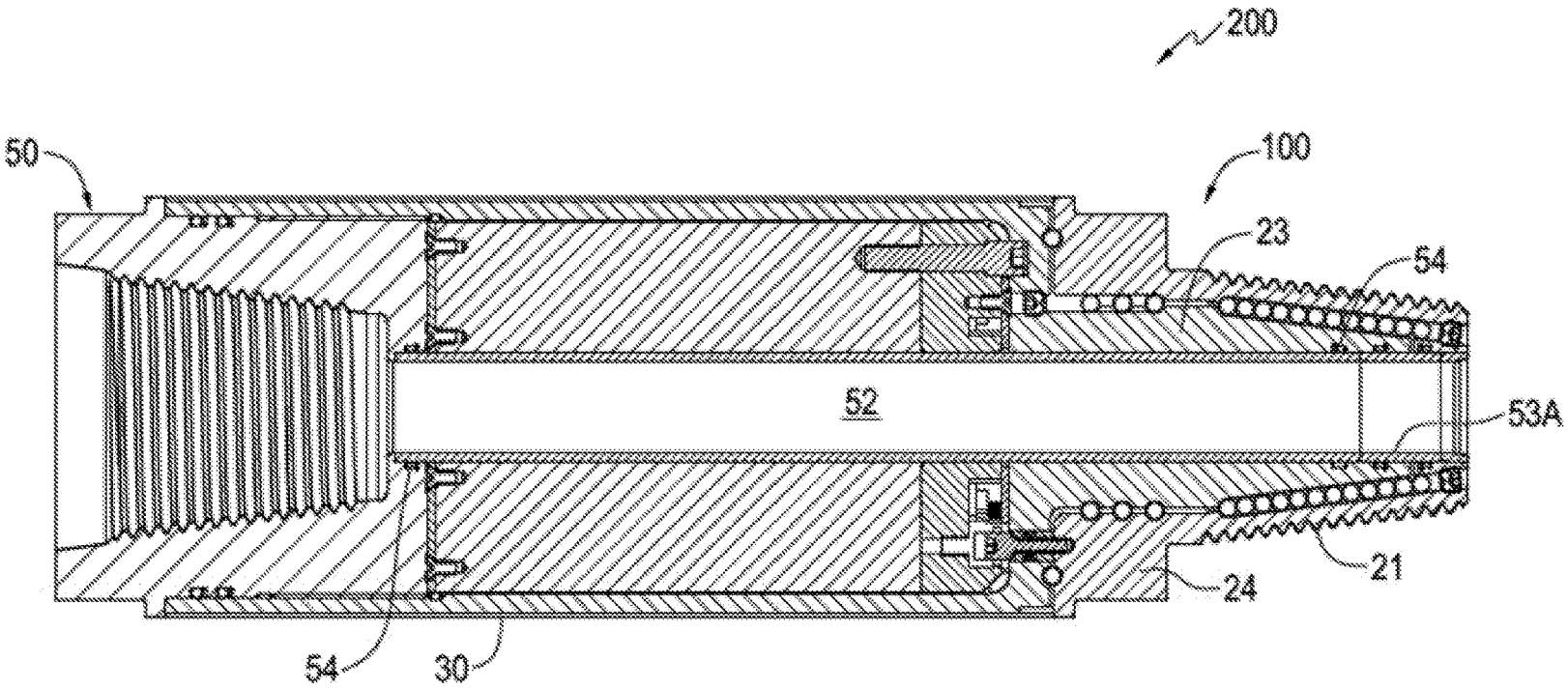
FIG. 6 is a longitudinal cross-section of a gap sub incorporating an example gap assembly.

FIG. 6 shows a gap sub 200 which includes a gap assembly 100. Gap sub 200 includes a box 50 on an end opposed to pin 21. A bore 52 extends between box 50 and pin 21. Bore 52 is lined with a flow tube 53. Flow tube 53 is sealed near its ends by O-rings or other seals 54. At least the portion of flow tube 53 that extends across the gap between male portion 23 and female portion 24 is made of an electrically-insulating material such as a suitable ceramic. In the illustrated embodiment, a section 53A of flow tube 53 is electrically-insulating. The remainder of flow tube 53 may be made of a suitable erosion-resistant and wear-resistant material.

Electronics, which may be housed in a cavity or chamber 35, can make electrical contact with either side of the gap by contacting bolt 32, which extends into as in electrical contact with female portion 24, and body 20.

In cases where the gap assembly is designed to permit the gap assembly to be disassembled and reassembled, one can appreciate that different female portions may be provided which include different couplings. For example, the different couplings may provide different thread profiles, thread pitches, thread tapers, or the like. This permits a single drill bit section to be readily adapted for being coupled to other drill string components that have different couplings.

An advantage of providing a connection by way of a bolt 32 or other similarly-located electrically-conductive member is that the electrically-conductive member which makes contact with female portion 24 is not exposed to drilling fluid.

While a number of exemplary aspects and embodiments have been discussed above, those of skill in the art will recognize certain modifications, permutations, additions and sub-combinations thereof. It is therefore intended that the following appended claims and claims hereafter introduced are interpreted to include all such modifications, permutations, additions and sub-combinations as are within their true spirit and scope.

Interpretation Of Terms

Unless the context clearly requires otherwise, throughout the description and the claims:

- "comprise," "comprising," and the like are to be construed in an inclusive sense, as opposed to an exclusive or exhaustive sense; that is to say, in the sense of "including, but not limited to".
- "connected," "coupled," or any variant thereof, means any connection or coupling, either direct or indirect, between two or more elements; the coupling or connection between the elements can be physical, logical, or a combination thereof.
- "herein," "above," "below," and words of similar import, when used to describe this specification shall refer to this specification as a whole and not to any particular portions of this specification.
- "or," in reference to a list of two or more items, covers all of the following interpretations of the word: any of the items in the list, all of the items in the list, and any combination of the items in the list.
- the singular forms "a," "an," and "the" also include the meaning of any appropriate plural forms.

Words that indicate directions such as "vertical," "transverse," "horizontal," "upward," "downward," "forward," "backward," "inward," "outward," "vertical," "transverse," "left," "right," "front," "back"," "top," "bottom," "below," "above," "under," and the like, used in this description and any accompanying claims (where present) depend on the specific orientation of the apparatus described and illustrated. The subject matter described herein may assume various alternative orientations. Accordingly, these directional terms are not strictly defined and should not be interpreted narrowly.

Where a component (e.g. a circuit, module, assembly, device, drill string component, drill rig system, etc.) is referred to above, unless otherwise indicated, reference to that component (including a reference to a "means") should be interpreted as including as equivalents of that component any component which performs the function of the described component (i.e., that is functionally equivalent), including components which are not structurally equivalent to the disclosed structure which performs the function in the illustrated exemplary embodiments of the invention.

Specific examples of systems, methods and apparatus have been described herein for purposes of illustration. These are only examples. The technology provided herein can be applied to systems other than the example systems described above. Many alterations, modifications, additions, omissions and permutations are possible within the practice of this invention. This invention includes variations on described embodiments that would be apparent to the skilled addressee, including variations obtained by: replacing features, elements and/or acts with equivalent features, elements and/or acts; mixing and matching of features, elements and/or acts from different embodiments; combining features, elements and/or acts from embodiments as described herein with features, elements and/or acts of other technology; and/or omitting combining features, elements and/or acts from described embodiments.

It is therefore intended that the following appended claims and claims hereafter introduced are interpreted to include all such modifications, permutations, additions, omissions and sub-combinations as may reasonably be inferred. The scope of the claims should not be limited by the preferred embodiments set forth in the examples, but should be given the broadest interpretation consistent with the description as a whole.

What is claimed is:

1. A gap assembly useful in subsurface drilling, the gap assembly comprising:

a drill string section having a longitudinal channel extending through it and a threaded pin at one end thereof for coupling to an adjacent drill string section wherein the drill string section comprises:

an electrically-conductive female portion having an outer surface which provides threads of the pin and an inner surface which defines a bore through the female portion; and, an electrically-conductive male portion comprising a projecting part extending axially from a first end thereof, the projecting part extending into the bore through the female portion and projecting longitudinally into the threads of the pin;

wherein the male and female portions are radially spaced apart from one another and electrically-insulated from one another.

2. A gap assembly according to claim 1 comprising rigid electrically-insulating spacers located between the male and female portions.

3. A gap assembly according to claim 2 wherein the male portion comprises a first flange face on the first end of the male portion surrounding the projecting part and the female portion comprises a second flange face facing the first flange face and a first plurality of the electrically-insulating spacers are received between the first and second flange faces.

4. A gap assembly according to claim 2 wherein a second plurality of the electrically-insulating spacers are received between the projecting part of the male portion and the inner surface of the female portion.

5. A gap assembly according to claim 4 wherein the projecting part of the male portion and the inner surface of the female potion are each formed to provide axially-extending grooves and at least some electrically-insulating spacers of the second plurality of electrically-insulating spacers are received between the axially-extending grooves of the projecting part of the male portion and the inner surface of the female portion.

6. A gap assembly according to claim 2 wherein the spacers comprise ceramic balls.

7. A gap assembly according to claim 1 wherein the projecting part of the male portion is tubular and the longitudinal channel of the drill string section extends through the projecting part of the male portion.

8. A gap assembly according to claim 1 comprising a sleeve of an electrically-insulating material provided on the outside of a body of the male portion, the sleeve covering a portion of the body of the male portion that is closest to the female portion.

9. A gap assembly according to claim 8 wherein the electrically-insulating material is selected from the group consisting of a glass-reinforced plastic, PEEK and ceramic.

10. A gap assembly according to claim 8 wherein the sleeve has a length in the range of 1 inch (about 2 ½ cm) to 20 inches (about 50 cm).

11. A gap assembly according to claim 1 comprising an electronics package housed in a cavity located between the longitudinal passage and an outer surface of the male portion.

12. A gap assembly according to claim 11 wherein the electronics package comprises one or both of an electromagnetic (EM) telemetry transmitter and an EM telemetry receiver connected electrically to each of the male portion and the female portion.

13. A gap assembly according to claim 1 wherein the space between the male and female portions is filled with solid, electrically-insulating material.

14. A gap assembly according to claim 1 wherein the female portion is removably coupled to the male portion.

15. A gap assembly according to claim 14 wherein the female portion is one of first and second interchangeable female portions having different configurations of threads on their outer surfaces.

16. A gap assembly according to claim 1 wherein the threads of the pin extend along the female portion for at least one half of the length of the female portion.

17. A gap assembly according to claim 1 comprising a dielectric liquid or fluid sealed in the gap between the male and female portions.

18. A drill string comprising a mud motor coupled to drive a drill bit and a gap assembly according to claim 1 between the mud motor and the drill bit.

19. A gap assembly useful in subsurface drilling, the gap assembly comprising:

a drill string section having a longitudinal channel extending through it and a threaded pin at one end thereof for coupling to an adjacent drill string section wherein the drill string section comprises:

an electrically-conductive female portion having an outer surface which provides threads of the pin and an inner surface which defines a bore through the female portion;

an electrically-conductive male portion comprising a projecting part extending axially from a first end thereof, the projecting part extending into the bore through the female portion and projecting longitudinally into the threads of the pin; and rigid electrically-insulating spacers located between the male and female portions;

wherein the male and female portions are spaced apart from one another and electrically-insulated from one another;

wherein the male portion comprises a first flange face on the first end of the male portion surrounding the projecting part and the female portion comprises a second flange face facing the first flange face and a first plurality of the electrically-insulating spacers are received between the first and second flange faces;

wherein the first and second flange faces each have a circumferentially-extending groove and the first plurality of the electrically-insulating spacers are received between the circumferentially-extending grooves of the first and second flange faces.

20. A gap assembly useful in subsurface drilling, the gap assembly comprising:

a drill string section having a longitudinal channel extending through it and a threaded pin at one end thereof for coupling to an adjacent drill string section wherein the drill string section comprises:

an electrically-conductive female portion having an outer surface which provides threads of the pin and an inner surface which defines a bore through the female portion;

an electrically-conductive male portion comprising a projecting part extending axially from a first end thereof, the projecting part extending into the bore through the female portion and projecting longitudinally into the threads of the pin; and rigid electrically-insulating spacers located between the male and female portions;

wherein the male and female portions are spaced apart from one another and electrically-insulated from one another;

wherein a second plurality of the electrically-insulating spacers are received between the projecting part of the male portion and the inner surface of the female portion;

wherein the projecting part of the male portion and the inner surface of the female potion are each formed to provide one or more circumferentially-extending grooves and at least some electrically-insulating spacers of the second plurality of electrically-insulating spacers are received between the circumferentially-extending grooves of the projecting part of the male portion and the inner surface of the female portion.

21. A gap assembly according to claim 20 comprising one or more fill ports respectively connected to the circumferentially-extending grooves, wherein the fill ports are located in a compartment contained within the gap assembly.

22. A gap assembly according to claim 21 wherein the compartment is sealed against downhole pressures.

23. A gap assembly according to claim 21 wherein the one or more circumferentially-extending grooves comprises a plurality of circumferentially-extending grooves and the one or more fill ports comprise a separate fill port for each one of the circumferentially-extending grooves.

24. A gap assembly according to claim 20 wherein the one or more circumferentially-extending grooves includes a groove that extends in a spiral or helix along the male portion.

25. A gap assembly useful in subsurface drilling, the gap assembly comprising:

a drill string section having a longitudinal channel extending through it and a threaded pin at one end thereof for coupling to an adjacent drill string section wherein the drill string section comprises:

an electrically-conductive female portion having an outer surface which provides threads of the pin and an inner surface which defines a bore through the female portion;

an electrically-conductive male portion comprising a projecting part extending axially from a first end thereof, the projecting part extending into the bore through the female portion and projecting longitudinally into the threads of the pin; and rigid electrically-insulating spacers located between the male and female portions;

wherein the male and female portions are spaced apart from one another and electrically-insulated from one another;

wherein the male portion includes:

a first portion comprising a flange face which faces a corresponding flange face of the female portion, a second portion which includes circumferential channels, and a third portion which includes axially-extending channels wherein at least some of the spacers are in contact with each one of the first, second and third portions.

26. A gap assembly useful in subsurface drilling, the gap assembly comprising:

a drill string section having a longitudinal channel extending through it and a threaded pin at one end thereof for coupling to an adjacent drill string section wherein the drill string section comprises:

an electrically-conductive female portion having an outer surface which provides threads of the pin and an inner surface which defines a bore through the female portion;

an electrically-conductive male portion comprising a projecting part extending axially from a first end thereof, the projecting part extending into the bore through the female portion and projecting longitudinally into the threads of the pin; and a flow tube extending through the longitudinal channel wherein at least in a vicinity of the end of the projecting part of the male portion the flow tube is made of an electrically-insulating material;

wherein the projecting part of the male portion is tubular and the longitudinal channel of the drill string section extends through the projecting part of the male portion;

wherein the male and female portions are spaced apart from one another and electrically-insulated from one another.

27. A gap assembly according to claim 26 wherein the flow tube comprises a first part axially aligned with a second part and seals sealingly arranged between the first and second parts and the longitudinal channel.

28. A gap assembly according to claim 27 wherein the first part of the flow tube is made of ceramic and the second part of the flow tube is made of metal and the end of the projecting part of the male portion lies within the first part of the flow tube.

29. A gap assembly useful in subsurface drilling, the gap assembly comprising:

a drill string section having a longitudinal channel extending through it and a threaded pin at one end thereof for coupling to an adjacent drill string section wherein the drill string section comprises:

an electrically-conductive female portion having an outer surface which provides threads of the pin and an inner surface which defines a bore through the female portion;

an electrically-conductive male portion comprising a projecting part extending axially from a first end thereof, the projecting part extending into the bore through the female portion and projecting longitudinally into the threads of the pin;

an electronics package housed in a cavity located between the longitudinal passage and an outer surface of the male portion; and a bolt extending from the cavity through an electrically-insulating sleeve, the bolt threadedly engaged with the female portion;

wherein the electronics package comprises one or both of an electromagnetic (EM) telemetry transmitter and an EM telemetry receiver connected electrically to each of the male portion and the female portion;

wherein the male and female portions are spaced apart from one another and electrically-insulated from one another.

30. A gap assembly according to claim 29 wherein one or both of the EM telemetry transmitter and the EM telemetry receiver is connected electrically to the female portion by way of the bolt.

31. A gap assembly useful in subsurface drilling, the gap assembly comprising:

an electrically-conductive first portion having a pin end comprising one or more first portion receivers;

an electrically-conductive second portion couplable to the pin end of the first portion and having a box end comprising one or more second portion receivers, the first portion receivers and the second portion receivers complementarily shaped to define one or more receiving areas to receive one or more spacers when the first and second portions are coupled at the pin end and the box end;

one or more axial channels defined by the first portion, the one or more axial channels extending in substantially an axial direction of the first portion and sized to receive the one or more spacers; and one or more circumferential channels defined by the first portion, each of the one or more circumferential channels defined about a circumference of the first portion, extending in a direction substantially transverse to the axial direction, and sized to receive the one or more spacers;

wherein, when the pin end of the first portion is coupled to the box end of the second portion and the one or more spacers are received by the one or more axial channels, the one or more circumferential channels, and the one or more receiving areas, the first and second portions are spaced apart to define a gap between the first and second portions so that the first portion is electrically isolated from the second portion.

* * * * *